US007682568B2

(12) United States Patent
Jarvimaki et al.

(10) Patent No.: US 7,682,568 B2
(45) Date of Patent: Mar. 23, 2010

(54) PIPETTE WITH TIP CONTAINER

(75) Inventors: Kari Jarvimaki, Espoo (FI); Mauno Heinonen, Vantaa (FI); Juha Miettinen, Vantaa (FI)

(73) Assignee: Thermo Electron Oy, Vantaa (FI)

( * ) Notice: Subject to any disclaimer, the term of this patent is extended or adjusted under 35 U.S.C. 154(b) by 1701 days.

(21) Appl. No.: 10/476,485

(22) PCT Filed: May 8, 2002

(86) PCT No.: PCT/FI02/00397

§ 371 (c)(1),
(2), (4) Date: May 26, 2004

(87) PCT Pub. No.: WO02/089983

PCT Pub. Date: Nov. 14, 2002

(65) Prior Publication Data

US 2004/0208793 A1 Oct. 21, 2004

(30) Foreign Application Priority Data

May 9, 2001 (FI) ..... 20010972

(51) Int. Cl.
*B01L 3/02* (2006.01)
*G01F 25/00* (2006.01)
*G01N 35/10* (2006.01)

(52) U.S. Cl. ..... 422/100; 73/1.74; 73/863.32; 73/864.13; 73/864.22; 73/864.23; 73/864.24

(58) Field of Classification Search ..... 422/100; 73/1.74, 863.32, 864.13, 864.22–864.24
See application file for complete search history.

(56) References Cited

U.S. PATENT DOCUMENTS

| | | | | | |
|---|---|---|---|---|---|
| 3,732,735 | A * | 5/1973 | Cohen | 73/864.16 |
| 4,117,728 | A * | 10/1978 | Johnson | 73/864.18 |
| 4,154,108 | A * | 5/1979 | Vollinger et al. | 73/864.13 |
| 4,215,092 | A * | 7/1980 | Suovaniemi et al. | 73/863.32 |
| 4,863,695 | A | 9/1989 | Fullemann | |
| 4,961,350 | A * | 10/1990 | Tennstedt | 73/864.01 |
| 5,336,468 | A * | 8/1994 | Tezuka et al. | 422/100 |
| 5,355,738 | A * | 10/1994 | Heinonen | 73/864.13 |
| 5,403,553 | A * | 4/1995 | Heinonen | 422/100 |
| 5,970,806 | A * | 10/1999 | Telimaa et al. | 73/864.17 |
| 6,143,252 | A * | 11/2000 | Haxo et al. | 506/40 |
| 6,352,673 | B1 * | 3/2002 | Rainin et al. | 422/100 |
| 6,814,936 | B1 * | 11/2004 | Enhorning | 422/100 |

(Continued)

FOREIGN PATENT DOCUMENTS

EP 293 075 11/1988

(Continued)

*Primary Examiner*—Walter D Griffin
*Assistant Examiner*—Natasha Young
(74) *Attorney, Agent, or Firm*—Oblon, Spivak, McClelland, Maier & Neustadt, L.L.P.

(57) ABSTRACT

A pipette including a cylinder part having a cylinder and a tip part, which includes a tip channel connected to the cylinder and a movable piston tightly fit within the cylinder for aspirating liquid into and removing liquid from the tip container attached to the cylinder. In the pipette at least the tip part is made of an elastic material, such as rubber. The tip container can thus be easily and reliably fixed to and removed from the tip container.

19 Claims, 1 Drawing Sheet

U.S. PATENT DOCUMENTS

| | | | | |
|---|---|---|---|---|
| 7,033,543 | B1 * | 4/2006 | Panzer et al. | 422/100 |
| 2002/0041833 | A1 * | 4/2002 | Telimaa et al. | 422/100 |

FOREIGN PATENT DOCUMENTS

| | | | |
|---|---|---|---|
| EP | 0293075 | | 11/1988 |
| EP | 1 401 580 | B1 | 11/2004 |
| FI | 84789 | | 5/1990 |
| FI | 92654 | | 11/1991 |
| WO | 91/16975 | | 11/1991 |
| WO | 9116975 | | 11/1991 |
| WO | WO 00/62933 | * | 10/2000 |

* cited by examiner

PIPETTE WITH TIP CONTAINER

TECHNICAL FIELD

The invention relates to a pipette comprising at least one cylinder part comprising a cylinder and a movable piston disposed within the cylinder, and a tip part comprising a tip channel connected with the cylinder, a tip container being attached to the end of the tip channel for aspirating liquid with the aid of the piston.

TECHNICAL BACKGROUND

There are known pipettes comprising a tip part with circular cross-section connected to a cylinder part, a separate removable tip container, i.e. tip, being attached to the tip part. The tip is usually maintained tightly in position with the aid of a cone joint. In order to seal the tip, the tip part may comprise a separate seal, an O-ring seal, for instance, or the otherwise rigid tip part may be coated with an elastic rubber-like material. A method and a device for fixing a rigid tip part coated with an elastic rubber-like material to a tip have been disclosed in FI patent specification 84789.

Currently used pipettes have the drawback of the tip being either too tightly or too loosely attached to the pipette tip part. In tip parts equipped with separate seals, contamination of the joint areas between the seals and other parts also involves a problem. In multi-channel pipettes, there is the additional problem of insecure attachment of the tips or of irregular attachment of the tips as the tips are spaced by varying distances. Poor attachment of the tips may cause leakage, dosage errors or additional work in order to attach or detach the tips.

Currently used pipette tip parts have a typical hardness of approx. 78 Shore D.

SUMMARY OF THE INVENTION

The purpose of the invention is to provide a pipette that overcomes the problems mentioned above.

The purpose of the invention is achieved by the means described in the independent claims. The dependent claims define some preferred embodiments of the invention.

The pipette of the invention is characterized in that at least the tip part of the cylinder part has been prepared so as to be flexible, and is made of an elastic material, such as rubber, that is softer than the tip. The tip is thus easy to attach and remove. As the tip part is being attached, it tends to be compressed to a smaller diameter, being tightly pressed against the tip. During removal, the tip is withdrawn by pulling it downwardly towards the tip part. The tip is easily detached from the tip part, because the cylinder part and the tip part stretch, resulting in a decrease of their diameter. Under these circumstances, the tip cannot be clogged as previously occurred in prior art pipettes. The invention is particularly useful in multi-channel pipettes, given the compensation of the distribution error of the channels or a row of pipettes to be attached with tips. In accordance with the invention, problems caused by thermal expansion can also be reduced.

The invention also allows a pipette with a reduced number of separate parts to be achieved.

In multi-channel pipettes, the elastic tip part facilitates the gripping of tips from a tip rack. Owing to the elastic tip parts, the rack distribution may even be carried out with a slightly coarser tolerance. In addition, even inclined tips will settle more securely and at the same height in tip parts.

Measured on the Shore scale, the maximum hardness of the tip part material may be e.g. 60 shore D, such as 50 Shore D, especially 45 Shore D. The minimum hardness of the material may be e.g. 30 Shore A, such as 45 Shore A, especially 58 Shore A.

The ratio of the thickness of the tip part wall to the diameter of the tip part may be e.g. 1/10-1/3, such as 1/6-1/4. The diameter of the tip part may be e.g. 1-10 mm, such as 2-8 mm, particularly 4-6 mm.

In a preferred embodiment of the invention, the cylinder part and the tip part are made of the same elastic material.

In a second preferred embodiment of the invention, the cylinder part and the tip part are made in one single piece. In this manner, the cylinder part and the tip part are of a simple design with an associated low cost to manufacture. In addition, as the tip part and the lower portion of the cylinder part have no separate seals with sealing grooves or similar contaminating folds or gaps, the tip part will remain cleaner and will also be easy to clean if necessary.

In a third preferred embodiment of the invention, the cylinder part comprises at least one seal that has been expanded by being pressed against the piston in order to seal the piston and the cylinder. By these means, a leak-proof cylinder is provided using a soft material and a straightforward and space-saving design is utilized.

In a fourth preferred embodiment of the invention, the cylinder part comprises in an upper portion thereof an O-ring seal pressed against a shoulder with a helical spring. The sealing between the cylinder and the piston is thus achieved in a simple and economical way using standard components.

DESCRIPTION OF THE DRAWINGS

Some embodiments of the invention are described in greater detail below with reference to the accompanying drawings, in which.

DESCRIPTION OF PREFERRED EMBODIMENTS

Figure 1:
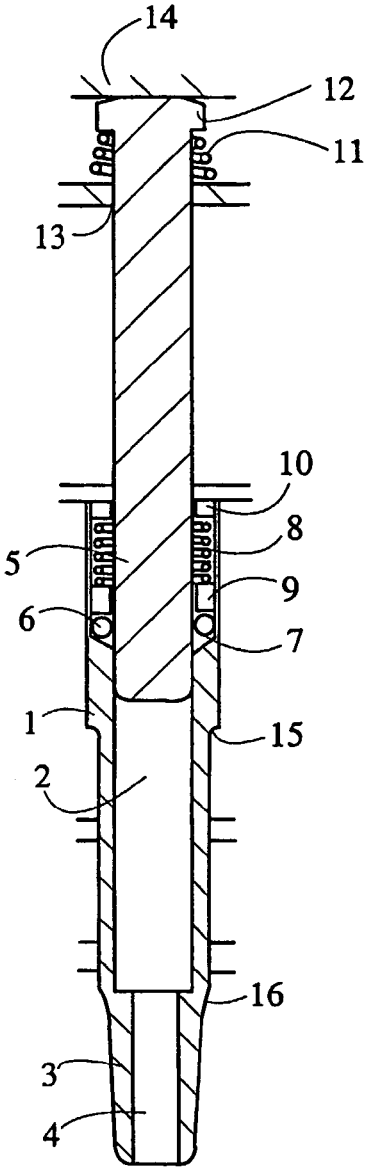
FIG. 1 shows the tip unit of a pipette of the invention in vertical cross-section.

The pipette of FIG. 1 has a cylinder part 1 comprising a cylinder 2, a tip part 3 having a tip channel 4 connected with the cylinder, and a piston 5 sealed to the cylinder with an O-ring seal pressed against the shoulder 7 by a spring 8. In addition, the pipette unit of FIG. 1 also comprises a press ring 9 for the O-ring seal and a lock ring 10 for the spring. The upper end of the piston comprises a floating mechanism for fixing the piston, comprising a piston spring 11, a piston flange 12 and a spring counter-plate 13. The force of the spring 11 is greater than the frictional force between the O-ring seal and the piston.

In the pipette unit shown in FIG. 1, the cylinder part 1 and the tip part 3 are made in one piece of the same rubber-like material. The outer surface of the cylinder part has been shaped so as to match the shape of the tip to be fixed to a lower part thereof, and on the other hand, to adapt to the requirements of its inner components. A shoulder 15 is provided slightly above its central point. Above the shoulder, the outer diameter of the cylinder part is greater than the lower portion, as shown in FIG. 1. The cylinder 2 located within the cylinder part extends from the upper portion of the cylinder part to the upper portion of the tip part, where it is connected to the tip channel 4 of the tip part. At the upper portion of the cylinder part 1, there is a part having a larger inner diameter for the sealing mechanism extending from the upper end of the cylinder part within the cylinder. The sealing mechanism consists of an O-ring seal 6 placed in the part having a larger inner diameter, the O-ring seal being expanded parallel to the cylinder radius by pressing it from above against a shoulder 7 provided underneath it by means of a press ring 9. The force required for pressing is generated by a spring 8 placed within the part having a larger inner diameter in the upper portion of the cylinder. The spring is tensioned between the press ring 9 and the lock ring 10. The lock ring is attached to the upper portion of the cylinder by means of a plate structure attached above the cylinder.

A reducing part 16 having more marked conicity than the tip part is provided between the cylinder part 1 and the tip part 3. It is intended to act as a transitional zone between the cylinder part 1 and the tip part 3, producing adequate thickness of the tip channel 4 connected to the lower end of the cylinder and thus adequate stiffness of the tip part relative 3 to the cylinder part 1, so that the material elasticity will be distributed relatively evenly between the cylinder part 1 and the tip part 3 as the tip is being attached. Centering of the elasticity to the cylinder part 1 under the effect of a tip part 3 markedly stiffer than the cylinder part 1 would entail more difficult fitting of the tip and thus deteriorated tip tightness and adhesion.

The tip part 3 has been shaped appropriately conical for the tip fitting the pipette unit to be fixed in position as easily as possible at the fitting stage and removed at the detaching stage. A tip fitting into the pipette unit of FIG. 1 has an upper portion that matches the shape of the tip part 3. At its lower portion, the tip usually has an appropriately conically shaped end known per se. The tip may be made of e.g. plastic, glass or any other material that is sufficiently rigid and otherwise suitable for this purpose as such as tip material for the sample substance.

Figure 2:
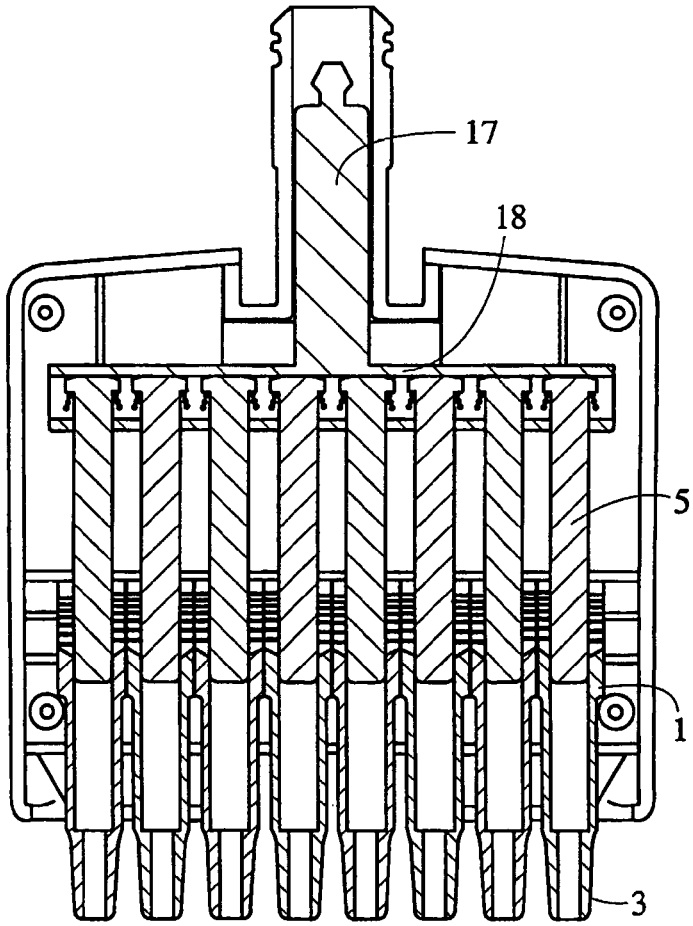
FIG. 2 shows a vertical cross-section parallel with the tip row of a multi-channel pipette made up of pipette units of FIG. 1.

FIG. 2 shows a multi-channel pipette made up of the pipette units of FIG. 1. It comprises eight pipette units fixed to the same frame. In order to move the pistons of the pipette units simultaneously, one single horizontal plunger member 18 connected to the plunger arm 17 has been fitted in the pipette. The pipette units have been fitted at the same height and the same mutual distance. Using the multi-tip pipette of FIG. 2, the tips are fixed by inserting the tip parts e.g. into tips placed at the tip part intervals in a suitable mounting rack. The pipette usually comprises a tip removing mechanism, by means of which the tips fixed to the tip part can be pushed so as to be detached from the tip part.

The design and the materials of the different parts of the pipette unit of the invention may vary. Unlike the preferred embodiment described above, the pipette unit may also comprise a cylinder part made of any rigid material, to which a tip part made of an elastic material has been connected. Unlike the design of FIG. 1, the cylinder part 1 and the tip part 3 may further be made of separate pieces, yet both made of a suitable elastic material, which may or may not be the same. The cylinder part 1 an the tip part 3 may have a shape different from that of FIG. 1, for instance shaped in some other way to match the shape of the inner surface of the conical tip. The size and tightness of the cylinder, the tip channel and the piston may also be carried out in many different ways. They can be determined as desired, for instance on the basis of the design and the material of the cylinder and the piston, and of the substances to be handled with the pipette. A support structure of a harder material, such as a ring, may be attached to a tip part made of an elastic material.

The pipette unit of the invention may be provided in a single-tip pipette, or a multichannel as shown in FIG. 2 can be formed of pipette units. The remaining components of a pipette formed of pipette units may be carried out in any manner suitable for the pipette of the invention. The pipette may also be electrically driven and/or equipped with electric measuring devices.

The invention claimed is:

1. A pipette comprising:

a cylinder part having a cylinder;

a movable piston fitted within the cylinder; and a tip part having a tip channel, which is connected to the cylinder and having an end to which a tip container is attachable by friction, wherein the tip part is made of an elastic material softer than the tip container and wherein the cylinder part and the tip part are made of a same elastic material.

2. A pipette as defined in claim 1, wherein the elastic material is rubber.

3. A pipette as defined in claim 1, wherein the cylinder part and the tip part are made in one single piece.

4. A pipette as defined in claim 1, wherein the elastic material of the tip part has a maximum hardness of 60 Shore D.

5. A pipette as defined in claim 4, wherein the elastic material has the maximum hardness of 50 Shore D.

6. A pipette as defined in claim 4, wherein the elastic material has the maximum hardness of 45 Shore D.

7. A pipette as defined in claim 1, wherein a ratio of wall thickness of the tip part to a tip part diameter is 1/10-1/3.

8. A pipette as defined in claim 7, wherein the ratio is 1/6-1/4.

9. A pipette as defined in claim 1, which comprises at least one additional cylinder part having a cylinder and a piston movably positioned in said cylinder.

10. A pipette as defined in claim 1, further comprising a spring, a press ring and an O-ring mounted in an upper portion of a wall of said cylinder part and wherein said O-ring is engageable with a shoulder portion of the cylinder part located within the wall of the cylinder part.

11. A pipette as defined in claim 10, wherein the shoulder portion of the cylinder part is an angled shoulder portion that is angled towards the piston such that the O-ring being engaged with the angled shoulder portion is biased towards the piston to seal the piston and the cylinder part.

12. A pipette unit having a cylinder part comprising:

a cylinder;

a piston movable within the cylinder; and a tip part having a tip channel, which is connected to the cylinder and to whose end a tip container is attachable by friction, wherein at least the tip part is made of an elastic material softer than the tip container and wherein the cylinder part and the tip part are made of a same elastic material.

13. A method for manufacturing a multi-channel pipette, wherein at least two pipette units of claim 12 are combined.

14. A pipette unit as defined in claim 12, further comprising a spring, a press ring and an O-ring mounted in an upper portion of a wall of said cylinder part and wherein said O-ring is engageable with a shoulder portion of the cylinder part located within the wall of the cylinder part.

15. A pipette unit as defined in claim 14, wherein the shoulder portion of the cylinder part is an angled shoulder portion that is angled towards the piston such that the O-ring being engaged with the angled shoulder portion is biased towards the piston to seal the piston and the cylinder part.

16. A pipette, comprising:

a cylinder part having a cylinder;

a movable piston fitted within the cylinder; and a tip part having a tip channel, which is connected to the cylinder and having an end to which a tip container is attachable by friction, wherein the tip part is made of an elastic material softer than the tip container and wherein said tip part consists of a single material.

17. A pipette as defined in claim 16, wherein the cylinder part has at least one seal expanded by being pressed against the piston to seal the piston and the cylinder part.

18. A pipette as defined in claim 16, further comprising a spring, a press ring and an O-ring mounted in an upper portion of a wall of said cylinder part and wherein said O-ring is engageable with a shoulder portion of the cylinder part located within the wall of the cylinder part.

19. A pipette as defined in claim 18, wherein the shoulder portion of the cylinder part is an angled shoulder portion that is angled towards the piston such that the O-ring being engaged with the angled shoulder portion is biased towards the piston to seal the piston and the cylinder part.

* * * * *